US011297914B1

(12) United States Patent
Coleman

(10) Patent No.: US 11,297,914 B1
(45) Date of Patent: Apr. 12, 2022

(54) UMBRELLA WITH HEATER

(71) Applicant: Wallace Coleman, Bowie, MD (US)

(72) Inventor: Wallace Coleman, Bowie, MD (US)

( * ) Notice: Subject to any disclaimer, the term of this patent is extended or adjusted under 35 U.S.C. 154(b) by 0 days.

(21) Appl. No.: 17/130,077

(22) Filed: Dec. 22, 2020

(51) Int. Cl.

| | |
|---|---|
| ***A45B 23/00*** | (2006.01) |
| ***A45B 25/02*** | (2006.01) |
| ***H05B 3/46*** | (2006.01) |
| *A45B 25/00* | (2006.01) |

(52) U.S. Cl.
CPC ..... *A45B 23/00* (2013.01); *A45B 25/02* (2013.01); *H05B 3/46* (2013.01); *A45B 2025/003* (2013.01); *A45B 2200/1036* (2013.01); *A45B 2200/1081* (2013.01)

(58) Field of Classification Search
CPC ..... A45B 2200/1036
See application file for complete search history.

(56) References Cited

U.S. PATENT DOCUMENTS

| | | | | |
|---|---|---|---|---|
| 2,531,735 A | | 11/1950 | Jones | |
| 3,739,792 A | | 6/1973 | Holland | |
| 4,368,749 A | * | 1/1983 | Lindler | A45B 25/02 135/15.1 |
| 5,349,975 A | * | 9/1994 | Valdner | A45B 3/00 135/16 |
| D521,229 S | | 5/2006 | Mariano | |
| 7,412,984 B1 | * | 8/2008 | Spencer | A45B 3/00 135/16 |
| 7,513,126 B2 | * | 4/2009 | Boland | A45B 3/00 62/310 |
| 7,537,015 B1 | * | 5/2009 | Molnar, IV | A45B 23/00 108/50.12 |
| 7,575,008 B1 | | 8/2009 | Casey | |
| 8,695,614 B2 | * | 4/2014 | Chaimovski | E04H 15/58 135/16 |
| 9,010,346 B2 | * | 4/2015 | Stankiewicz | A45B 3/00 135/16 |
| 10,238,191 B2 | | 3/2019 | Shurie | |
| 2008/0271767 A1 | | 11/2008 | Farrington | |
| 2009/0283121 A1 | * | 11/2009 | Chu | A45B 3/00 135/16 |
| 2013/0167886 A1 | | 7/2013 | Crain | |
| 2015/0059814 A1 | * | 3/2015 | Hao | A45B 25/00 135/16 |
| 2015/0366305 A1 | * | 12/2015 | Edwards | A45B 25/00 135/16 |
| 2018/0352922 A1 | * | 12/2018 | Shurie | A45B 25/00 |

* cited by examiner

*Primary Examiner* — Noah Chandler Hawk
(74) *Attorney, Agent, or Firm* — Kyle A. Fletcher, Esq.

(57) ABSTRACT

The umbrella with heater includes an umbrella, a heating subsystem, an air moving subsystem, a recharging subsystem, and one or more operator controls. The umbrella may be a collapsible cover adapted to keep rain, snow, and sunlight off of a user. The heating subsystem may produce warm air that may be released from a plurality of ribs of the umbrella during cold weather. The air moving subsystem may move the warm air into the plurality of ribs. The recharging subsystem may recharge a battery located within a handle of the umbrella. A canopy of the umbrella may comprise a waterproof coating. The one or more operator controls may be adapted for the user to enable and disable the heating subsystem, the air moving subsystem, or combinations thereof.

19 Claims, 5 Drawing Sheets

UMBRELLA WITH HEATER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal weather accessories, more specifically, an umbrella with heater.

SUMMARY OF INVENTION

The umbrella with heater comprises an umbrella, a heating subsystem, an air moving subsystem, a recharging subsystem, and one or more operator controls. The umbrella may be a collapsible cover adapted to keep rain, snow, and sunlight off of a user. The heating subsystem may produce warm air that may be released from a plurality of ribs of the umbrella during cold weather. The air moving subsystem may move the warm air into the plurality of ribs. The recharging subsystem may recharge a battery located within a handle of the umbrella. A canopy of the umbrella may comprise a waterproof coating. The one or more operator controls may be adapted for the user to enable and disable the heating subsystem, the air moving subsystem, the recharging subsystem, or combinations thereof.

An object of the invention is to provide a cover to keep rain, snow, and sunlight off of a user.

Another object of the invention is to provide a heating subsystem to expel warm air from ribs of the umbrella.

A further object of the invention is to provide an air moving subsystem to circulate air through the umbrella such that the air passes through the heating subsystem.

Yet another object of the invention is to provide a recharging subsystem that comprises a rectenna.

These together with additional objects, features and advantages of the umbrella with heater will be readily apparent to those of ordinary skill in the art upon reading the following detailed description of the presently preferred, but nonetheless illustrative, embodiments when taken in conjunction with the accompanying drawings.

In this respect, before explaining the current embodiments of the umbrella with heater in detail, it is to be understood that the umbrella with heater is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the umbrella with heater.

It is therefore important that the claims be regarded as including such equivalent construction insofar as they do not depart from the spirit and scope of the umbrella with heater. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore there is no intention to be bound by any expressed or implied theory presented in the preceding technical field, background, brief summary or the following detailed description. As used herein, the word "or" is intended to be inclusive.

Figure 1:
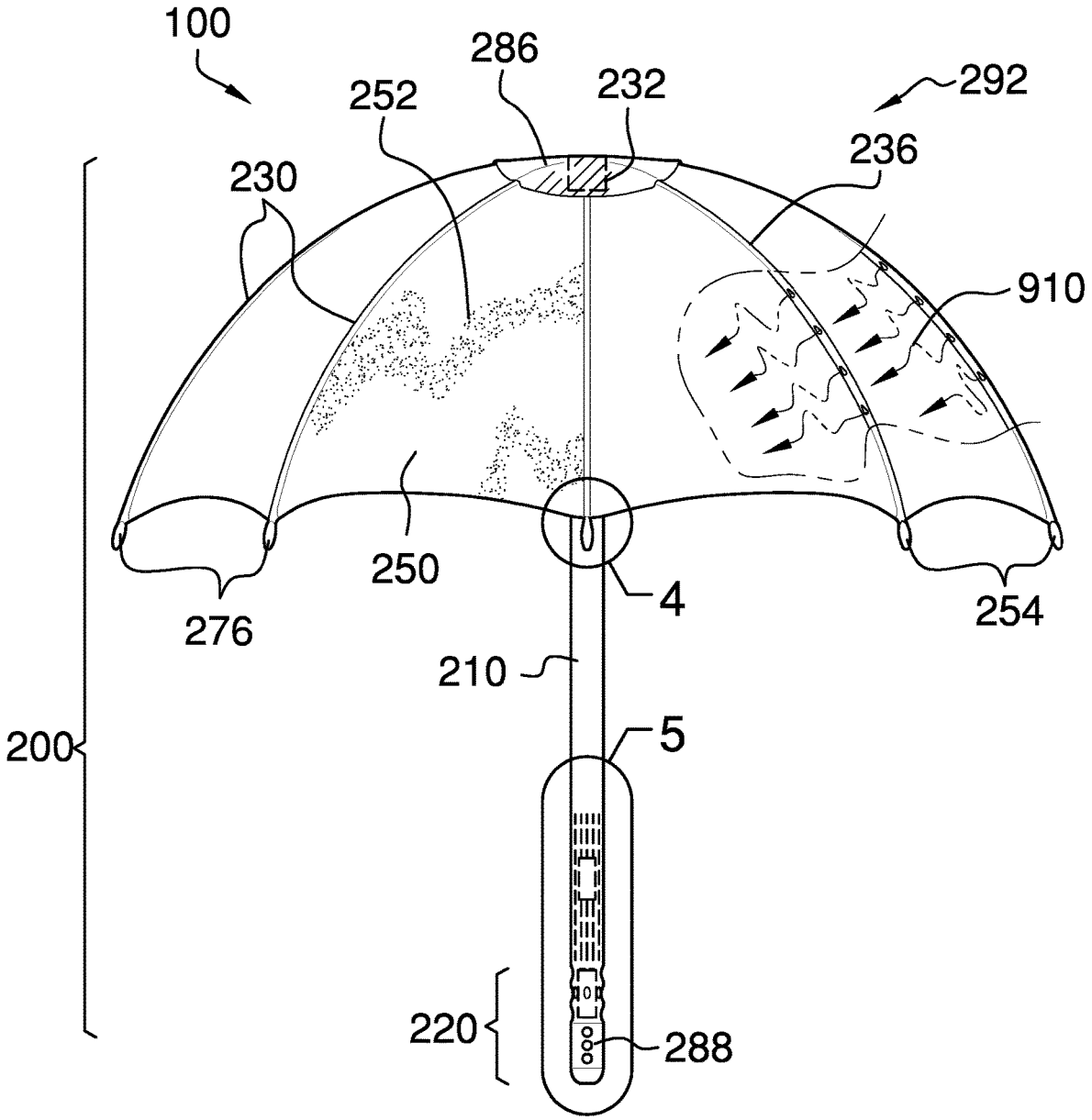
FIG. 1 is a front view of an embodiment of the disclosure.
Figure 2:
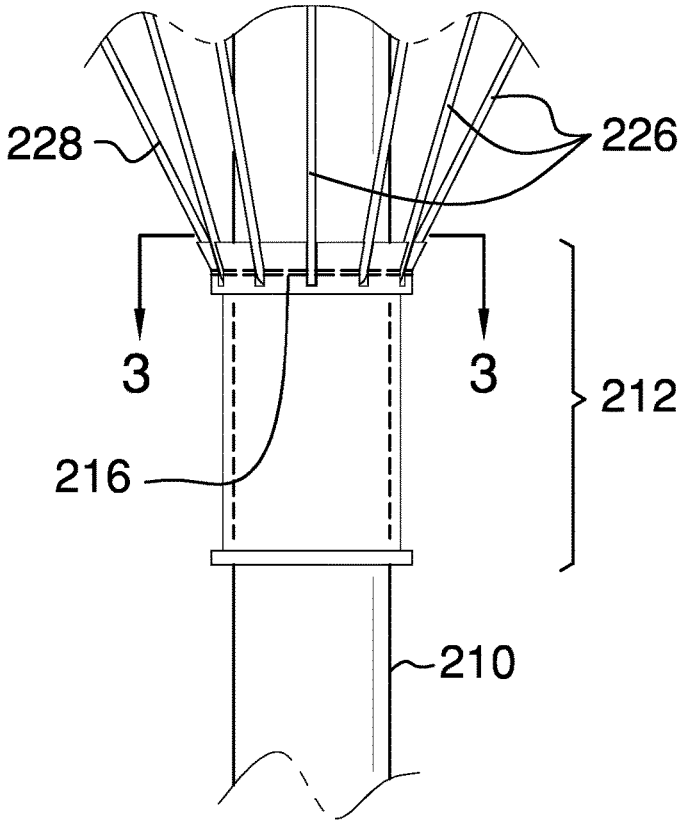
FIG. 2 is a detail view of an embodiment of the disclosure illustrating the runner.
Figure 3:
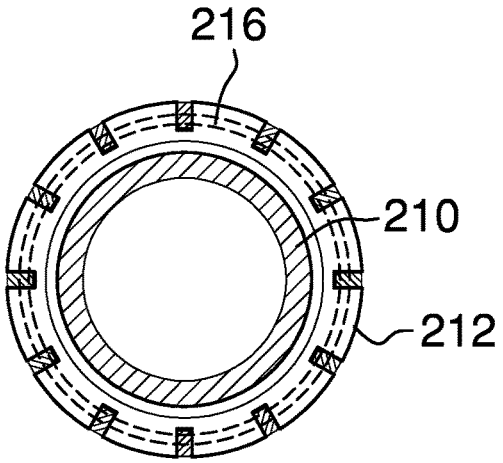
FIG. 3 is a cross-sectional view of an embodiment of the disclosure across 3-3 as shown in FIG. 2.
Figure 4:
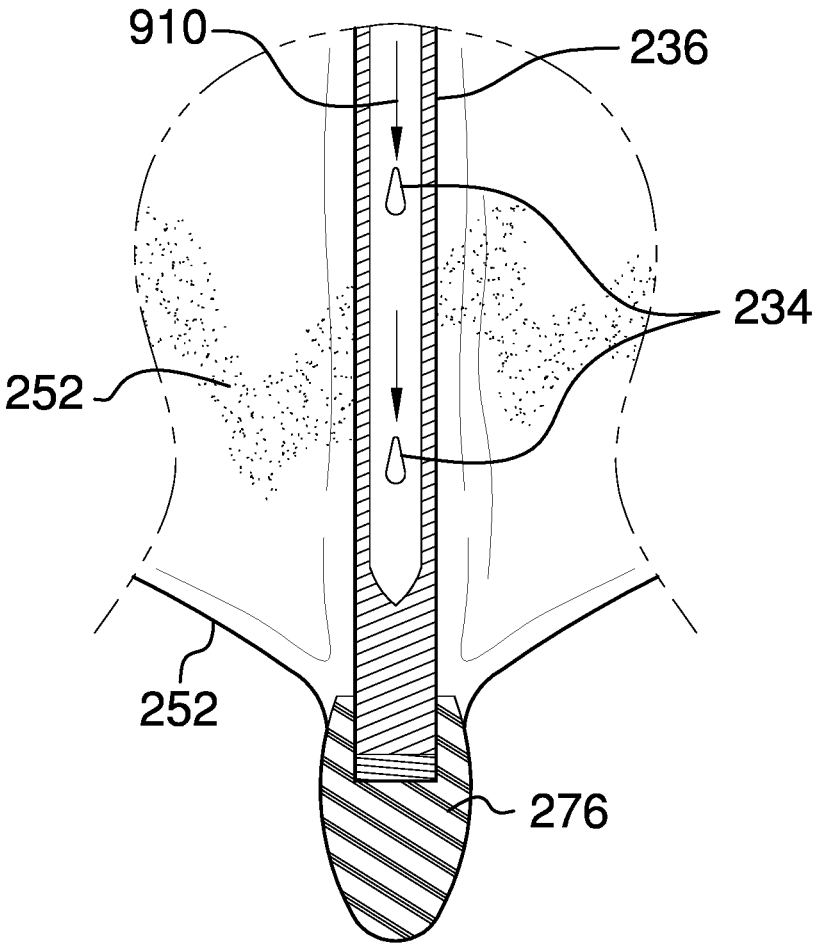
FIG. 4 is a detail view of an embodiment of the disclosure illustrating the distal end of a rib.
Figure 5:
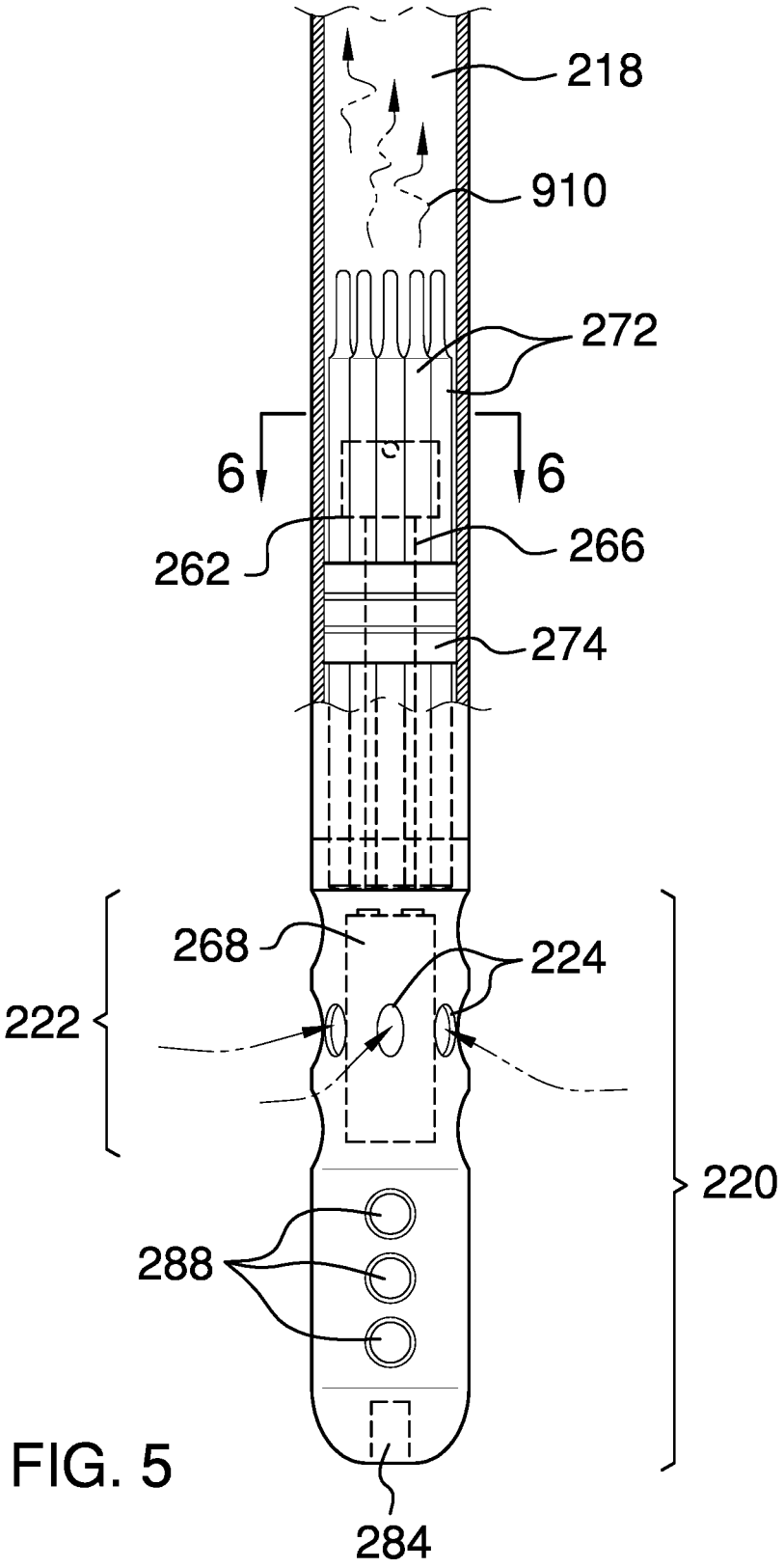
FIG. 5 is a detail view of an embodiment of the disclosure illustrating the area of the handle and lower shaft.
Figure 6:
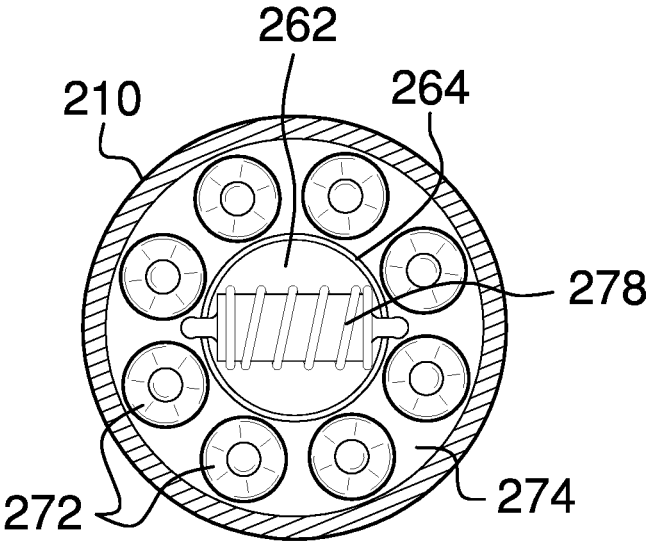
FIG. 6 is a cross-sectional view of an embodiment of the disclosure across 6-6 as shown in FIG. 5.
Figure 7:
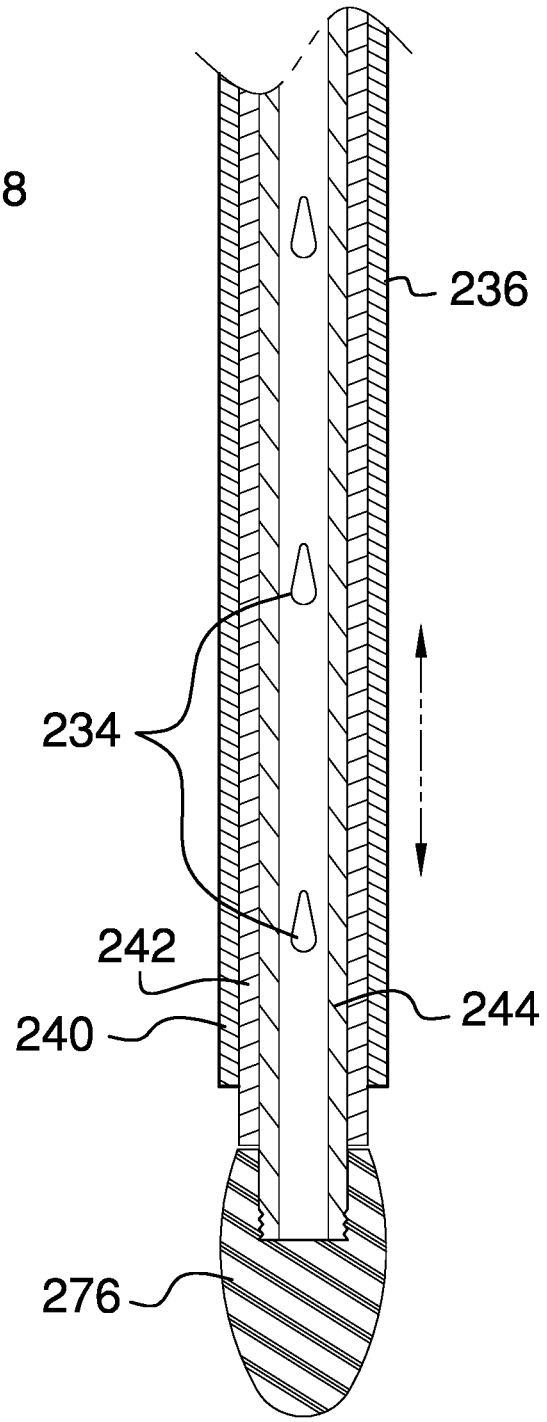
FIG. 7 is a detail view of an embodiment of the disclosure illustrating the outer sheath, intermediate sheath, and inner sheath of a rib.

Detailed reference will now be made to a first potential embodiment of the disclosure, which is illustrated in FIGS. 1 through 7.

The umbrella with heater 100 (hereinafter invention) comprises an umbrella 200, a heating subsystem, an air moving subsystem, a recharging subsystem, and one or more operator controls 288. The umbrella 200 may be a collapsible cover adapted to keep rain, snow, and sunlight off of a user. The rain, the snow, and the sunlight may be collectively referred to as weather. The heating subsystem may produce warm air 910 that may be released from a plurality of ribs 230 of the umbrella 200 during cold weather. The air moving subsystem may move the warm air 910 into the plurality of ribs 230. The recharging subsystem may recharge a battery 268 located within a handle 220 of the umbrella 200. A canopy 250 of the umbrella 200 may comprise a waterproof coating 252. The one or more operator controls 288 may be adapted for the user to enable and disable the heating subsystem, the air moving subsystem, the recharging subsystem, or combinations thereof.

The umbrella 200 may comprise a shaft 210, the handle 220, a plurality of stretchers 226, the plurality of ribs 230, and the canopy 250. The umbrella 200 may be carried in a closed configuration. The umbrella 200 may be adapted to open to a deployed configuration 292 when needed to protect the user from the weather.

The shaft 210 may be a vertical armature at the center of the umbrella 200. The bottom of the shaft 210 may couple to the handle 220. The top of the shaft 210 may couple to a top hub 232. The shaft 210 may comprise a runner 212. The runner 212 may be a hollow cylinder operable to slide up and down on the shaft 210. The inside end of the plurality of stretchers 226 may be pivotably coupled to the top of the runner 212 such that pushing the runner 212 up on the shaft 210 may push the plurality of stretchers 226 against the plurality of ribs 230, thus causing the umbrella 200 to open. The runner 212 may comprise a locking mechanism to keep the umbrella 200 open or closed when the runner 212 is pushed up or pulled down. In some embodiments, the locking mechanism may be a locking shaft ring 216.

The shaft 210 may comprise a hollow interior 218 such that the heating subsystem and the air moving subsystem may be housed within the shaft 210. The hollow interior 218 may also provide a pathway for the warm air 910 to travel to the top of the umbrella 200 and then out to the plurality of ribs 230.

The handle 220 may be the bottom of the shaft 210. The handle 220 may be adapted to be held by the user. The handle 220 may comprise a contoured grip 222 such that the umbrella 200 is more comfortable to hold. The handle 220 may comprise a plurality of air intake apertures 224 to allow air to enter the shaft 210.

The plurality of stretchers 226 may be armatures that support the plurality of ribs 230. The bottoms of the plurality of stretchers 226 may pivotably couple to the runner 212. The tops of the plurality of stretchers 226 may pivotably couple to the plurality of ribs 230. An individual stretcher 228 may couple to an individual rib 236 in a one-to-one correspondence.

The plurality of ribs 230 may be coupled to the underside of the canopy 250 and may shape the canopy 250. The proximal end of the plurality of ribs 230 may pivotably couple to the top hub 232. When the umbrella 200 is in the closed configuration, the plurality of ribs 230 may be oriented substantially parallel to the shaft 210 and may pull the canopy 250 in towards the shaft 210. When the umbrella 200 is in the deployed configuration 292, the plurality of ribs 230 may be oriented substantially perpendicular to the shaft 210 and may stretch the canopy 250 into a dome shape. The plurality of ribs 230 may be hollow such that the warm air 910 may pass through the plurality of ribs 230. The plurality of ribs 230 may comprise a plurality of air outlet apertures 234 where the warm air 910 may escape. The plurality of air outlet apertures 234 may be dispersed along the individual rib 236 on the underside of the individual rib 236, away from the canopy 250.

The top hub 232 may comprise a top hub plenum which may be a hollow center of the top hub 232. The hollow interior 218 of the shaft 210 may supply the warm air 910 to the top hub plenum. The proximal ends of the plurality of ribs 230 may align with the top hub plenum when the umbrella 200 is in the deployed configuration 292 such that the warm air 910 may flow from the top hub plenum into the plurality of ribs 230. The warm air 910 may exit the plurality of ribs 230 via the plurality of air outlet apertures 234.

The canopy 250 may be a flexible fabric panel that may be adapted to form a dome over the user when the umbrella 200 is in the deployed configuration 292. The canopy 250 may be coupled to a plurality of tips 254 dispersed around the periphery of the canopy 250. There may be a one-to-one correspondence between the plurality of tips 254 and the plurality of ribs 230 and the plurality of tips 254 may cover the distal end of the plurality of ribs 230. In some embodiments, the canopy 250 may be treated with the waterproof coating 252 to repel water.

The heating subsystem may comprise a heater 262 and the battery 268. The heating subsystem may heat air drawn in via the plurality of air intake apertures 224 and may disperse the warm air 910 via the plurality of air outlet apertures 234. The heater 262 may be a heating element located within the shaft 210 above the plurality of air intake apertures 224. The heater 262 may be thermally insulated from the shaft 210 by a ceramic case 264 and may be supported by a heater support 266. The heater 262 may be energized by the battery 268. The one or more operator controls 288 may be operable to energize or to deenergize the heater 262.

The battery 268 may comprise one or more energy-storage devices. The battery 268 may be a source of electrical energy to operate the heating subsystem and the air moving subsystem. The battery 268 may be replaceable or rechargeable.

The air moving subsystem may comprise a plurality of first electrodes 272, a plurality of second electrodes 276, and a coil 278. The plurality of first electrodes 272 and the plurality of second electrodes 276 may be held at a difference in electrical potential. The air moving subsystem may cause the movement of the warm air 910 through the umbrella 200, from the plurality of air intake apertures 224 to the plurality of air outlet apertures 234, by stimulating charged ions to move from the plurality of first electrodes 272 to the plurality of second electrodes 276 due to the difference in electrical potential. As a non-limiting example, the plurality of first electrodes 272 may be held at a more positive potential than the plurality of second electrodes 276, or vice versa. The difference in electrical potential may be quite high—hundreds or even thousands of volts in some embodiments. However, the current available from the coil 278 may be very small—on the order of microamperes—such that the air moving subsystem may not pose a safety risk. The difference in electrical potential between the plurality of first electrodes 272 and the plurality of second electrodes 276 may be generated by the coil 278. In some embodiments, the coil 278 may produce the high voltage electrical by interrupting the DC current flow into the coil, thus producing an expanding and collapsing magnetic field around the coil 278. The collapsing magnetic field may induce a high voltage which may be rectified by a diode to produce the difference in electrical potential that may vary in intensity but may maintain a consistent polarity.

The plurality of first electrodes 272 may be located within the shaft 210. The plurality of first electrodes 272 may be electrically isolated from the shaft 210 by one or more insulated spacers 274. The plurality of second electrodes 276 may be located at the distal ends of the plurality of ribs 230.

In some embodiments, the individual rib 236 may comprise an inner sheath 244, an intermediate sheath 242, and an outer sheath 240. The inner sheath 244 may be a hollow inner tube of the individual rib 236 through which the warm air 910 may pass. The inner sheath 244 may be electrically insulated from the intermediate sheath 242. The intermediate sheath 242 may be a middle tube of the individual rib 236. The intermediate sheaths 242 may surround the inner sheaths 244 and may be in electrical contact with the plurality of second electrodes 276. The intermediate sheaths 242 may conduct the difference in electrical potential to the plurality of second electrodes 276. The outer sheath 240 may be an outer layer of the individual rib 236. The outer sheaths 240 may surround the intermediate sheaths 242. The outer sheath 240 may be electrically and thermally insulated. The plurality of air outlet apertures 234 may pass through the inner sheath 244, the intermediate sheath 242, and the outer sheath 240 to allow the warm air 910 to escape from within the inner sheath 244.

The recharging subsystem may comprise a USB recharging port 284 and a rectenna 286. The recharging subsystem may be operable to recharge the battery 268. A USB cable may be removably coupled to the USB recharging port 284 to transfer power to the battery 268.

The rectenna 286 may receive radio waves and may rectify the radio waves to provide DC current. The DC current may be passed from the rectenna 286 to the battery 268 to recharge the battery 268.

In use, an umbrella 200 may be carried in a closed configuration in case inclement weather is expected. In the event of rain of snow, the umbrella 200 may be placed in a deployed configuration 292 by sliding a runner 212 up along a shaft 210 and locking the runner 212 in place. Sliding the runner 212 up may cause a plurality of ribs 230 to pivot and stretch a canopy 250 into a dome shape. The canopy 250 may then be held over a user to protect the user from rain or snow. In cold weather, a heating subsystem may be energized using one or more operator controls 288. When energized, the heating subsystem pull air into a plurality of air intake apertures 224, heat the air, and expel warm air 910 via a plurality of air outlet apertures 234 located on the plurality of ribs 230 of the umbrella 200. The warm air 910 may then circulate around the user's head and shoulders. An air moving subsystem may enhance the circulation of the warm air 910 by creating a difference in electrical potential between a plurality of first electrodes 272 and a plurality of second electrodes 276. Since the plurality of first electrodes 272 may be located within the shaft 210 and the plurality of second electrodes 276 may be located at the distal ends of the plurality of ribs 230, the difference in electrical potential may cause charged ions to follow a path through the shaft 210, a top hub 232, and the plurality of ribs 230, drawing the warm air 910 as the ions move. A battery 268 may be recharged by plugging a USB cable into a USB recharging port 284 or automatically by exposing a rectenna 286 to radio waves.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy or stored energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", may refer to connecting, either directly or indirectly, and does not necessarily imply a mechanical connection.

As used in this disclosure, "DC" may be an acronym for direct current.

As used in this disclosure, a "diode" may be a two terminal semiconductor device that allows current flow in only one direction. The two terminals are called the anode and the cathode. Electric current is allowed to pass from the anode to the cathode.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used herein, "energize" and/or "energization" may refer to the application of an electrical potential to a system or subsystem.

As used in this disclosure, "flexible" may refer to an object or material which will deform when a force is applied to it, which will not return to its original shape when the deforming force is removed, and which may not retain the deformed shape caused by the deforming force.

As used herein, "handle" may refer to an object by which a tool, object, or door is held or manipulated with the hand.

As used in this disclosure, the word "interior" may be used as a relational term that implies that an object is located or contained within the boundary of a structure or a space.

As used in this disclosure, the term "intermediate" may refer to a location that lies between a first object and a second object As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used herein, "rectenna" may refer to a rectifying antenna. A rectenna may be a special type of receiving antenna that is used for converting electromagnetic energy into direct current (DC) electricity. A rectenna may be used in wireless power transmission systems that transmit power by radio waves. A simple rectenna element consists of a dipole antenna with an RF diode connected across the dipole elements. The diode rectifies the AC induced in the antenna by the radio waves to produce DC power which may power a load connected across the diode. Schottky diodes are usually used because they have the lowest voltage drop and highest speed and therefore have the lowest power losses due to conduction and switching. Large rectennas may consist of an array of many such dipole elements.

As used in this disclosure, a "runner" may be a component of an umbrella that fits over the center post of the umbrella. Stretchers are used to connect the ribs of the umbrella to the runner which in turn connects the runner to the center post. By raising the runner, the stretchers expand the ribs to create a structure upon which the canopy of the umbrella is placed.

As used in this disclosure, a "sheath" may be a shell that is used to cover all or a portion of an object. In some cases, the object may be movable within the sheath. In some cases, the object may be inserted and withdrawn.

As used in this disclosure, an "umbrella" may be a device used for protection against the weather, including rain, sun, and snow, comprising a canopy made of a textile or sheeting that is mounted on a folding metal frame and is supported by a central rod.

As used in this disclosure, "USB" may be an acronym for Universal Serial Bus which is an industry standard that defines the cables, the connectors, the communication protocols and the distribution of power required for interconnections between electronic devices. The USB standard defines several connectors including, but not limited to, USB-A, USB-B, USB-C, mini-USB, and micro USB connectors.

As used in this disclosure, "vertical" may refer to a direction that is parallel to the local force of gravity. Unless specifically noted in this disclosure, the vertical direction is always perpendicular to horizontal.

As used herein, the word "waterproof" may refer to an object that is not harmed when being exposed to water, including total submersion for a period of time. When used as a verb, "waterproof" may refer to taking steps to make an object waterproof. Non-limiting examples of such steps may include applying special coatings or using gaskets to seal seams and entry points of an enclosure.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An umbrella with heater comprising:

an umbrella, a heating subsystem, an air moving subsystem, and one or more operator controls;

wherein the umbrella is a collapsible cover adapted to keep rain, snow, and sunlight off of a user;

wherein the heating subsystem produces warm air that is released from a plurality of ribs of the umbrella during cold weather;

wherein the air moving subsystem moves the warm air into the plurality of ribs;

wherein the umbrella comprises a shaft, a handle, a plurality of stretchers, the plurality of ribs, and a canopy;

wherein the handle comprises a plurality of air intake apertures to allow air to enter the shaft;

wherein the plurality of ribs comprise a plurality of air outlet apertures where the warm air escapes;

wherein the heating subsystem comprises a heater and the battery;

wherein the heating subsystem heats air drawn in via the plurality of air intake apertures and disperses the warm air via the plurality of air outlet apertures;

wherein the heater is a heating element located within the shaft above the plurality of air intake apertures;

wherein the heater is thermally insulated from the shaft by a ceramic case and is supported by a heater support;

wherein the heater is energized by the battery;

wherein the one or more operator controls are operable to energize or to deenergize the heater.

2. The umbrella with heater according to claim 1 wherein the umbrella is carried in a closed configuration;

wherein the umbrella is adapted to open to a deployed configuration when needed to protect the user from the weather.

3. The umbrella with heater according to claim 2 wherein the shaft is a vertical armature at the center of the umbrella;

wherein the bottom of the shaft couples to the handle;

wherein the top of the shaft couples to a top hub;

wherein the shaft comprises a runner;

wherein the runner is a hollow cylinder operable to slide up and down on the shaft;

wherein the inside end of the plurality of stretchers are pivotably coupled to the top of the runner such that pushing the runner up on the shaft pushes the plurality of stretchers against the plurality of ribs, thus causing the umbrella to open;

wherein the runner comprises a locking mechanism to keep the umbrella open or closed when the runner is pushed up or pulled down.

4. The umbrella with heater according to claim 3 wherein the locking mechanism is a locking shaft ring.

5. The umbrella with heater according to claim 3 wherein the shaft comprises a hollow interior such that the heating subsystem and the air moving subsystem are housed within the shaft;

wherein the hollow interior provides a pathway for the warm air to travel to the top of the umbrella and then out to the plurality of ribs.

6. The umbrella with heater according to claim 5 wherein the handle is the bottom of the shaft;

wherein the handle is adapted to be held by the user;

wherein the handle comprises a contoured grip.

7. The umbrella with heater according to claim 6
wherein the plurality of stretchers are armatures that support the plurality of ribs;
wherein the bottoms of the plurality of stretchers pivotably couple to the runner;
wherein the tops of the plurality of stretchers pivotably couple to the plurality of ribs;
wherein an individual stretcher couples to an individual rib in a one-to-one correspondence.

8. The umbrella with heater according to claim 7
wherein the plurality of ribs are coupled to the underside of the canopy and shape the canopy;
wherein the proximal end of the plurality of ribs pivotably couple to the top hub;
wherein when the umbrella is in the closed configuration, the plurality of ribs are oriented parallel to the shaft and pull the canopy in towards the shaft;
wherein when the umbrella is in the deployed configuration, the plurality of ribs are oriented perpendicular to the shaft and stretch the canopy into a dome shape;
wherein the plurality of ribs are hollow such that the warm air passes through the plurality of ribs;
wherein the plurality of air outlet apertures are dispersed along the individual rib on the underside of the individual rib, away from the canopy.

9. The umbrella with heater according to claim 8
wherein the top hub comprises a top hub plenum;
wherein the hollow interior of the shaft supplies the warm air to the top hub plenum;
wherein the proximal ends of the plurality of ribs align with the top hub plenum when the umbrella is in the deployed configuration such that the warm air flows from the top hub plenum into the plurality of ribs;
wherein the warm air exits the plurality of ribs via the plurality of air outlet apertures.

10. The umbrella with heater according to claim 9
wherein the canopy is a flexible fabric panel that is adapted to form a dome over the user when the umbrella is in the deployed configuration;
wherein the canopy is coupled to a plurality of tips dispersed around the periphery of the canopy;
wherein there is a one-to-one correspondence between the plurality of tips and the plurality of ribs and the plurality of tips cover the distal end of the plurality of ribs.

11. The umbrella with heater according to claim 10
wherein the canopy is treated with a waterproof coating to repel water.

12. The umbrella with heater according to claim 10
wherein the battery comprises one or more energy-storage devices;
wherein the battery is a source of electrical energy to operate the heating subsystem and the air moving subsystem;
wherein the battery is replaceable and rechargeable.

13. The umbrella with heater according to claim 12
wherein the air moving subsystem comprises a plurality of first electrodes, a plurality of second electrodes, and a coil;
wherein the plurality of first electrodes and the plurality of second electrodes are held at a difference in electrical potential;
wherein the air moving subsystem causes the movement of the warm air through the umbrella, from the plurality of air intake apertures to the plurality of air outlet apertures, by stimulating charged ions to move from the plurality of first electrodes to the plurality of second electrodes due to the difference in electrical potential.

14. The umbrella with heater according to claim 13
wherein the plurality of first electrodes are located within the shaft;
wherein the plurality of first electrodes are electrically isolated from the shaft by one or more insulated spacers;
wherein the plurality of second electrodes are located at the distal ends of the plurality of ribs.

15. The umbrella with heater according to claim 14
wherein the individual rib comprises an inner sheath, an intermediate sheath, and an outer sheath;
wherein the inner sheath is a hollow inner tube of the individual rib through which the warm air passes;
wherein the inner sheath is electrically insulated from the intermediate sheath;
wherein the intermediate sheath is a middle tube of the individual rib;
wherein the intermediate sheaths surround the inner sheaths and are in electrical contact with the plurality of second electrodes;
wherein the intermediate sheaths conduct the difference in electrical potential to the plurality of second electrodes;
wherein the outer sheath is an outer layer of the individual rib;
wherein the outer sheaths surround the intermediate sheaths.

16. The umbrella with heater according to claim 15
wherein the outer sheath is electrically and thermally insulated.

17. The umbrella with heater according to claim 16
wherein the plurality of air outlet apertures pass through the inner sheath, the intermediate sheath, and the outer sheath to allow the warm air to escape from within the inner sheath;
wherein a recharging subsystem is included, and recharges a battery located within the handle of the umbrella;
wherein the one or more operator controls are adapted for the user to enable and disable the heating subsystem, the air moving subsystem, the recharging subsystem, or combinations thereof.

18. The umbrella with heater according to claim 17
wherein the recharging subsystem comprises a USB recharging port and a rectenna;
wherein the recharging subsystem is operable to recharge the battery;
wherein a USB cable is removably coupled to the USB recharging port to transfer power to the battery.

19. The umbrella with heater according to claim 18
wherein the rectenna receives radio waves and rectifies the radio waves to provide DC current;
wherein the DC current is passed from the rectenna to the battery to recharge the battery.

* * * * *